US007074551B2

(12) United States Patent
Rao et al.

(10) Patent No.: US 7,074,551 B2
(45) **Date of Patent: *Jul. 11, 2006**

(54) IMAGING MATERIAL WITH IMPROVED MECHANICAL PROPERTIES

(75) Inventors: YuanQiao Rao, Pittsford, NY (US); Robert J. Kress, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 81 days.

This patent is subject to a terminal disclaimer.

(21) Appl. No.: 10/633,904

(22) Filed: Aug. 4, 2003

(65) Prior Publication Data

US 2005/0031983 A1 Feb. 10, 2005

(51) Int. Cl.
*G03C 1/79* (2006.01)
*G03C 1/93* (2006.01)

(52) U.S. Cl. ..... 430/531; 430/533; 430/534; 430/535; 430/621; 430/622; 430/623; 430/624; 430/625; 430/628; 430/631; 430/640; 430/641; 430/642; 430/643; 430/930; 428/32.2; 428/32.22; 428/32.26; 428/32.35

(58) Field of Classification Search ..... 430/621, 430/622, 623, 624, 625, 628, 631, 640, 641, 430/642, 643, 531, 533, 534, 535, 539, 200, 430/201, 930; 428/32.2, 32.26, 32.22, 32.35
See application file for complete search history.

(56) References Cited

U.S. PATENT DOCUMENTS

| | | | | |
|---|---|---|---|---|
| 2,173,480 | A | 9/1939 | Jung | |
| 2,259,009 | A | 10/1941 | Talbot | |
| 2,331,746 | A | 10/1943 | Talbot | |
| 2,536,764 | A | 1/1951 | Moulton | |
| 2,706,686 | A | 4/1955 | Hilborn | |
| 2,798,004 | A | 7/1957 | Weigel | |
| 3,113,867 | A | 12/1963 | Van Norman et al. | |
| 3,190,197 | A | 6/1965 | Pinder | |
| 3,397,980 | A | 8/1968 | Stone | |
| 3,415,670 | A | 12/1968 | McDonald | |
| 3,443,946 | A | 5/1969 | Grabhofer et al. | |
| 3,502,501 | A | 3/1970 | Burczyk et al. | |
| 3,617,354 | A | 11/1971 | Carnahan et al. | |
| 3,697,277 | A | 10/1972 | King | |
| 3,733,293 | A | 5/1973 | Gallagher et al. | |
| 4,092,173 | A | 5/1978 | Novak et al. | |
| 5,552,469 | A | 9/1996 | Beall et al. | |
| 5,578,672 | A | 11/1996 | Beall et al. | |
| 5,683,862 | A | 11/1997 | Majumdar et al. | |
| 5,753,426 | A | 5/1998 | Nair et al. | |
| 5,800,977 | A * | 9/1998 | Taylor et al. | 430/621 |
| 5,866,287 | A | 2/1999 | Christian et al. | |
| 5,869,217 | A | 2/1999 | Aono | |
| 5,891,611 | A | 4/1999 | Majumdar et al. | |
| 6,060,230 | A | 5/2000 | Christian et al. | |
| 6,300,049 | B1 * | 10/2001 | Eichorst et al. | 430/529 |
| 6,667,148 | B1 * | 12/2003 | Rao et al. | 430/350 |
| 2002/0123015 | A1 | 9/2002 | Majumdar et al. | |
| 2003/0070583 | A1 | 4/2003 | Siegel et al. | |
| 2003/0099815 | A1 | 5/2003 | Dontula et al. | |
| 2003/0100656 | A1 | 5/2003 | Majumdar et al. | |

FOREIGN PATENT DOCUMENTS

| | | |
|---|---|---|
| EP | 0 780 340 B1 | 3/2002 |
| EP | 1 310 528 A1 | 5/2003 |
| WO | 93/11190 | 6/1993 |

* cited by examiner

*Primary Examiner*—Thorl Chea
(74) *Attorney, Agent, or Firm*—Lynne M. Blank

(57) ABSTRACT

The present invention relates to an imaging element comprising at least one imaging layer and a support wherein the support comprises at least one layer comprising a splayant and a layered material, wherein the layered material has an aspect ratio from 20:1 and 500:1 and wherein the layered material comprises less than 10% by weight of the layer. The present invention also relates to a method of making a dimensionally stable imaging element comprising providing a support wherein said support comprises at least one layer comprising a splayant and a layered material, wherein said layered material comprises an aspect ratio of from 20:1 to 500:1 and wherein said layered material comprises less than 10% by weight of said at least one layer; and applying at least one imaging layer.

28 Claims, No Drawings

IMAGING MATERIAL WITH IMPROVED MECHANICAL PROPERTIES

CROSS REFERENCE TO RELATED APPLICATIONS

Reference is made to commonly assigned, co-pending U.S. patent application Ser. No. 10/633,806 by Rao et al. filed of even date herewith entitled "Imaging Material With Improved Scratch Resistance", the disclosure of which is incorporated herein.

FIELD OF THE INVENTION

The present invention relates to imaging elements having improved mechanical properties as a result of incorporation of a layer containing intercalated and/or exfoliated layered material.

BACKGROUND OF THE INVENTION

The need for thinner and stiffer bases for imaging products is well recognized. In addition to providing cost advantages, thinner supports may fulfill many other criteria. For example, in motion picture and related entertainment industries, thinner photographic base allows for longer film footage for the same sized reels. Display materials, such as photographic papers, should be light in weight and flexible for particular applications. For instance, when the photographs are mailed or used as a laminating material, it is desirable that the materials be light in weight. When stored in albums, reduced thickness of the paper will minimize undesirable bulkiness. For some uses, such as for a stand-up display and to convey a sense of value, it is desirable that the photographs have a heavy stiff feel. The cost of forming stiff paper is substantial, as increases in the amount and stiffness of the raw materials are expensive. It would be desirable if photographic materials could be easily produced with a variety of stiffness and caliper characteristics so that a variety of consumer desires could be easily met.

Unfortunately, a reduction in thickness of the base typically results in a reduction in stiffness, which may have detrimental effects in terms of, for example, curl, transport, and durability. In addition, changes, that is, increases or decreases, in caliper that are required for papers of increased or decreased stiffness lead to difficulties in handling in film manufacturing machines and in development after exposure.

Efforts to control the deleterious properties resulting from the use of thinner films or supports have included the use of one or more curl control layers on the back-side of the support of a photographic film element. The curl control layer or layers prevent excessive curl in the element upon drying of the coated light-sensitive layers. The curl control layers also prevent curl when the exposed film is developed and ensure that the film element remains sufficiently flat in a camera or printer during exposure and printing to optimize focus conditions. The clay-containing layer facilitates transport of the film through a camera and processing apparatus.

Back-side curl control layers typically comprise a hydrophilic binder coated from an aqueous formulation, and are of sufficient total thickness upon drying (generally from 1–25 micrometers) to off-set the curl generated by the hydrophilic binder layers on the light-sensitive emulsion layer side of the support. The use of curl control layers is especially important where a transparent magnetic recording layer is included in relatively wide (that is, wider than 35 mm) roll camera films, such as 120 and 220 medium format films, and sheet films including x-ray and graphic arts films, as such films are generally more sensitive to curl and the resulting degradation of magnetic recording performance associated with variable head-media spacing. Optimized ratios of the thicknesses of light sensitive layers, magnetic recording layers, and curl control layers comprising hydrophilic colloids in photographic elements for curl control are described, in U.S. Pat. No. 5,753,426, and U.S. Pat. No. 5,866,287, the disclosure of which is incorporated by reference herein.

Polymeric thin film and coatings have been widely used to improve the overall stiffness of an imaging element. Polymeric thin films are also used as the curl control layer. However, the mechanical properties of the polymeric thin films are limited by the material used to make the coatings. Different methods have been utilized to enhance the properties of these thin films, such as using higher molecular weight polymer, adding toughening agent, and adding fiber and inorganic filler. However, the introduction of the foreign materials into the system often deteriorates the optical clarity of the film.

Problem to be Solved

There remains a need for an imaging element with improved dimensional stability, such as resistance to curl, which also has acceptable optical clarity and mechanical properties.

SUMMARY OF THE INVENTION

The present invention relates to an imaging element comprising at least one imaging layer and a support wherein the support comprises at least one layer comprising a splayant and a layered material, wherein the layered material has an aspect ratio from 20:1 and 500:1 and wherein the layered material comprises less than 10% by weight of the layer. The present invention also relates to a method of making a dimensionally stable imaging element comprising providing a support wherein said support comprises at least one layer comprising a splayant and a layered material, wherein said layered material comprises an aspect ratio of from 20:1 to 500:1 and wherein said layered material comprises less than 10% by weight of said at least one layer; and applying at least one imaging layer.

Advantageous Effect of the Invention

The present invention includes several advantages, not all of which are incorporated in a single embodiment. The invention provides imaging materials comprising nanocomposites, which possess a number of highly desirable properties, such as improved mechanical, thermal, and barrier properties at a relatively low weight % loading of the inorganic phase. The imaging element containing splayed layered materials may provide improved mechanical properties while retaining optical clarity necessary for use in imaging applications. The present invention provides curl control while using less material and producing a thinner layer. The present invention may provide an overall thinner film, making more compact photofinishing possible. It also reduces the overall stiffness and increases film flexibility, thus making the transportation of the film easier.

DETAILED DESCRIPTION OF THE INVENTION

Whenever used in the specification the terms set forth shall have the following meaning:

"Nanocomposite" shall mean a composite material wherein at least one component comprises an inorganic phase, such as clay or other layered material, with at least one dimension in the 0.1 to 100 nanometer range.

"Plates" shall mean particles with two comparable dimensions significantly greater than the third dimension, for example, length and width of the particle being of comparable size but orders of magnitude greater than the thickness of the particle.

"Layered material" shall mean an inorganic material, such as a smectite clay, that is in the form of a plurality of adjacent bound layers.

"Platelets" shall mean individual layers of the layered material.

"Intercalation" shall mean the insertion of one or more foreign molecules or parts of foreign molecules between platelets of the layered material, usually detected by X-ray diffraction technique, as illustrated in U.S. Pat. No. 5,891,611 (line 10, col. 5–line 23, col. 7).

"Intercalant" shall mean the aforesaid foreign molecule inserted between platelets of the aforesaid layered material.

"Intercalated" shall refer to layered material that has at least partially undergone intercalation and/or exfoliation.

"Exfoliation" or "delamination" shall mean separation of individual platelets in to a disordered structure, without any stacking order.

"Organo layered material" shall mean layered material modified by organic molecules.

"Splayed" layered materials are defined as layered materials which are completely intercalated with no degree of exfoliation, totally exfoliated materials with no degree of intercalation, as well as layered materials which are both intercalated and exfoliated including disordered layered materials.

"Splaying" refers to the separation of the layers of the layered material, which may be to a degree, which still maintains a lattice-type arrangement, as in intercalation, or to a degree which spreads the lattice structure to the point of loss of lattice structure, as in exfoliation or a combination of both.

"layered material-containing layer" refers to the at least one layer comprising a splayant and a layered material.

The present invention relates to an imaging element comprising a support, an imaging layer, and at least one layer comprising a splayed, preferably an intercalated, layered material.

The layered materials most suitable for this invention include materials in the shape of plates with significantly high aspect ratio. However, other shapes with high aspect ratio will also be advantageous. The layered materials suitable for this invention may comprise clays or non-clays. These materials include phyllosilicates, e.g., montmorillonite, particularly sodium montmorillonite, magnesium montmorillonite, and/or calcium montmorillonite, nontronite, beidellite, volkonskoite, hectorite, saponite, sauconite, sobockite, stevensite, svinfordite, vermiculite, magadiite, kenyaite, talc, mica, kaolinite, and mixtures thereof. Other useful layered materials include illite, mixed layered illite/smectite minerals, such as ledikite and admixtures of illites with the layered materials named above. Other useful layered materials, particularly useful with anionic thermoplastic polymers, are the layered double hydroxide clays or hydrotalcites, such as $Mg_6Al_{3.4}(OH)_{18.8}(CO_3)_{1.7}H_2O$, which have positively charged layers and exchangeable anions in the interlayer spaces. Other layered materials having little or no charge on the layers may be useful provided they can be splayed with swelling agents, which expand their interlayer spacing. Such materials include chlorides such as $FeCl_3$, FeOCl, chalcogenides, such as $TiS_2$, $MoS_2$, and $MoS_3$, cyanides such as $Ni(CN)_2$ and oxides such as $H_2Si_2O_5$, $V_6O_{13}$, $HTiNbO_5$, $Cr_{0.5}V_{0.5}S_2$, $V_2O_5$, Ag doped $V_2O_5$, $W_{0.2}V_{2.8}O7$, $Cr_3O_8$, $MoO_3(OH)_2$, $VOPO_4$-$2H_2O$, $CaPO_4CH_3$—$H_2O$, $MnHAsO_4$—$H_2O$, and $Ag_6Mo_{10}O_{33}$. Preferred layered materials are swellable so that other agents, usually organic ions or molecules, can intercalate and/or exfoliate the layered material resulting in a desirable dispersion of the inorganic phase. These swellable layered materials include phyllosilicates of the 2:1 type, as defined in the literature (for example, "An introduction to clay colloid chemistry," by H. van Olphen, John Wiley & Sons Publishers). Typical phyllosilicates with ion exchange capacity of 50 to 300 milliequivalents per 100 grams are preferred. Preferred layered materials for the present invention include clays, especially smectite clay such as montmorillonite, nontronite, beidellite, volkonskoite, hectorite, saponite, sauconite, sobockite, stevensite, svinfordite, halloysite, magadiite, kenyaite and vermiculite as well as layered double hydroxides or hydrotalcites. Most preferred layered materials include montmorillonite, hectorite and hydrotalcite, which are capable of intercalation and/or exfoliation by a variety of molecules, and also commercially available in large quantities.

The aforementioned layered materials can be natural or synthetic, for example, synthetic smectites. This distinction can influence the particle size and/or the level of associated impurities. Typically, synthetic layered materials may be smaller in lateral dimension, and therefore possess smaller aspect ratio. For this invention, the clay particles should have a lateral dimension below 700 nm (0.7 m). In preferred embodiments, the lateral dimension is between 0.01 μm and 5 μm, and preferably between 0.05 μm and 2 μm, and more preferably between 0.1 μm and 1 μm. The thickness or the vertical dimension of the clay particles can preferably vary between 0.5 nm and 10 nm, and more preferably between 1 nm and 5 nm. The aspect ratio, which is the ratio of the largest and smallest dimension of the layered material should be greater than 20:1, more preferably from 20:1 to 500:1 and most preferably from 100:1 to 400:1. The aforementioned limits regarding the size and shape of the particles are to ensure adequate improvements in some properties of the nanocomposites without deleteriously affecting others. For example, a large lateral dimension may result in an increase in the aspect ratio, a desirable criterion for improvement in mechanical properties. However, very large particles can be abrasive to processing equipment.

The layered material used in this invention may be pristine clay or an organoclay. Organoclays may be produced by interacting the unfunctionalized clay with suitable splayants, that is, intercalants and/or exfoliants. These splayants may be typically organic compounds, which may be neutral or ionic. Useful neutral organic molecules include polar molecules such as amides, esters, lactams, nitrites, ureas, carbonates, phosphates, phosphonates, sulfates, sulfonates, and nitro compounds. The neutral organic intercalants utilized with the organoclays may be monomeric, oligomeric or polymeric. Neutral organic molecules can cause intercalation in the layers of the layered materials through hydrogen bonding, without completely replacing the original charge balancing ions. Useful ionic compounds may be cationic surfactants including onium species such as ammonium (primary, secondary, tertiary, and quaternary), phosphonium, or sulfonium derivatives of aliphatic, aromatic or arylaliphatic amines, phosphines and sulfides. Typically onium ions can cause intercalation in the layers through ion exchange with the metal cations of the preferred smectite clay. A number of commercial organoclays are available from clay vendors, which may be used in the practice of this invention.

The layered material comprises less than 10% by weight of the layer containing layered material. Most preferably, the layer will contain from 0.5 to 10 wt. % of the layer containing layered material.

In the present invention, the layered material comprises a splayed material, that is, an intercalated and/or exfoliated material. Generally, this is accomplished by treating the selected layered material, such as clay, to separate the agglomerates of platelet particles to individual platelet particles and small tactoids prior to making a composite layer. Any treatment that achieves the above goals may be used. Examples of useful treatments include intercalation with water soluble or water insoluble polymers, organic reagents or monomers, silane compounds, metals or organometallics, organic cations, and their combinations. In a preferred embodiment the layered material is splayed, that is, intercalated and/or exfoliated, by an organic splayant, which comprises from 30 to 90 percent weight percent of the layered material-containing layer.

The layered material particles useful in the invention layer may be splayed, that is, intercalated and/or exfoliated, with one or more hydrophilic polymers. There are many of such polymers known in the art, for example as described in U.S. Pat. No. 5,683,862 (Majumdar et al.), U.S. Pat. No. 5,891,611 (Majumdar et al.), and U.S. Pat. No. 6,060,230 (Christian et al.). The water soluble polymers may comprise polyalkylene oxides such as polyethylene oxide, poly 6,(2-ethyloxazolines), poly(ethyleneimine), poly(vinyl pyrrolidone), poly(vinyl alcohols), poly(vinyl acetate), poly(styrene sulfonate), poly(acrylamides), poly(methacrylamides), poly(N,N-dimethacrylamide), poly(N-isopropylacrylamide), polysaccharides, dextrans, and cellulose derivatives such as carboxymethyl cellulose, hydroxyethyl cellulose, and others known in the art.

The hydrophilic polymers preferably include gelatin or gelatin grafted polymers, including alkali-treated gelatin (cattle bone or hide gelatin), acid-treated gelatin (pigskin or bone gelatin), and gelatin derivatives such as partially phthalated gelatin, acetylated gelatin, and deionized gelatins.

Particularly useful splayant polymers comprise intercalating hydrophilic or water-dispersible polymers, which may include one or more poly(vinyl alcohols), gelatin and gelatin derivatives, poly(ethylene oxide), poly(vinyl pyrrolidones), poly(carboxylic acids), a poly(sulfonic acid), poly(acrylamides), and quaternized polymers. Mixtures of these materials also may be used if desired.

Examples of useful pretreatment with polymers and oligomers include those disclosed in U.S. Pat. No. 5,552,469 and U.S. Pat. No. 5,578,672, incorporated herein by reference. Examples of useful hydrophobic polymers for splaying, that is, intercalating and/or exfoliating, the platelet particles include polytetrahydrofuran, polystyrene, polycaprolactone, certain water dispersable polyesters, Nylon-6. Examples of useful pretreatment with organic reagents and monomers include those disclosed in EP 780,340 A1, incorporated herein by reference. Examples of useful organic reagents and monomers for splaying, that is, intercalating and/or exfoliating, the platelet particles include dodecylpyrrolidone, caprolactone, aprolactam, ethylene carbonate, ethylene glycol, bishydroxyethyl terephthalate, dimethyl terephthalate, or mixtures thereof. Examples of useful pretreatment with silane compounds include those treatements disclosed in WO 93/11190, incorporated herein by reference. Examples of useful silane compounds includes (3-glycidoxypropyl)trimethoxysilane, 2-methoxy(polyethyleneoxy)propyl heptamethyl trisiloxane, octadecyl dimethyl (3-trimethoxysilylpropyl)ammonium chloride. Examples of useful organic cations include, but are not limited to, alkyl ammonium ions, such as dodecyl ammonium, octadecyl ammonium, bis(2-hydroxyethyl)octadecyl methyl ammonium, octadecyl benzyl dimethyl ammonium, tetramethyl ammonium, or mixtures thereof, and alkyl phosphonium ions such as tetrabutyl phosphonium, trioctyl octadecyl phosphonium, tetraoctyl phosphonium, octadecyl triphenyl phosphonium, or mixtures thereof. Illustrative examples of suitable polyalkoxylated ammoniium compounds include those available under the trade name Ethoquadg or Ethomeen® from Akzo Chemie America, namely, Ethoquad® 18/25 which is octadecyl methyl bis(polyoxyethylene[15]) ammonium chloride and Ethomeen® 18/25 which is octadecyl bis(polyoxyethylene[15])amine, wherein the numbers in brackets refer to the total number of ethylene oxide units. The most preferred organic cation is octadecyl methyl bis(polyoxyethylene{5})ammonium chloride.

The layered material, preferably clay, of the invention may also be further treated with a compatibilizing agent. The purpose of the compatibilizing agent is to render the inorganic layered material phase more compatible with the binder polymer in which the layered material is preferably dispersed. Typically, the compatibilizing agent comprises a component that bonds with the layered material surface and another component that interacts favorably with the binder polymer. Effective compatibilization leads to a homogenous dispersion of the layered material in the binder polymer.

The layer of the invention may comprise any other material known in the art. These materials include surfactants, defoamers or coating aids, charge control agents, thickeners or viscosity modifiers, coalescing aids, crosslinking agents or hardeners, soluble and/or solid particle dyes, antifoggants, fillers, matte beads, inorganic or polymeric particles, antistatic or electrically conductive agents, other adhesion promoting agents, bite solvents or chemical etchants, lubricants, plasticizers, antioxidants, voiding agents, colorants or tints, roughening agents, and other addenda.

In a preferred embodiment, the layer may comprise electrically conductive agents to function as an antistatic layer, and control static charging during manufacturing, finishing and end use of the imaging element. Thus, in this embodiment, the layer of the invention may fulfill the dual purpose of curl control as well as static control. In this embodiment, any of the electrically conductive agents known in the art for antistatic application may be effectively incorporated in the layered material-containing layer of the present invention. These electrically conductive agents may comprise an ionic conductor or an electronic conductor or both.

In another preferred embodiment of the invention, the layer of the invention comprises pigments such as colorants or tints, typically used in imaging elements. In display type imaging members, such as photographic paper, the resin layer coated or laminated on the paper base, may also serve as a carrier layer for titanium dioxide and other whitening materials as well as tinting materials. It may be desirable to produce a support with a bluish tint for particular applications. In those embodiments, the preferred color of the pigment or pigment combinations used in the invention is blue, so that it offsets the native yellowness of the gelatin, yielding a neutral background for the imaging layers. Suitable pigments used in this invention may be any inorganic or organic, colored materials such as those disclosed in U.S. Pat. No. 6,180,330. The preferred pigments are organic, as described in Industrial Organic Pigments: Production, Properties, Applications by W. Herbst and K. Hunger, 1993, Wiley Publishers. These pigments may include azo pigments, such as monoazo yellow and orange, disazo, naphthol, naphthol reds, azo lakes, benzimidazolone, disazo condensation, metal complex, isoindolinone and isoindoline, polycyclic pigments, such as phthalocyanine, quinacridone, perylene, perinone, diketopyrrolo pyrrole and thioindigo, and anthrquinone pigments such as anthrapyrimidine, flavanthrone, pyranthrone, anthanthrone, dioxazine, triarylcarbodium and quinophthalone. The most preferred pigments are the anthraquinones, such as Pigment Blue 60, phthalocyanines such as Pigment Blue 15, 15:1, 15:3, 15:4 and 15:6, and quinacridones such as Pigment Red 122, (see NPIRI Raw Materials Data Handbook, Vol. 4, Pigments, 1983, National Printing Research Institute.) These pigments have a dye hue sufficient to overcome the native yellowness of the gelatin layer and are easily dispersed in an aqueous solution.

The layered material-containing layer of the invention may comprise any number of hardeners or crosslinking agents in any amount known in the art for use in imaging elements. Preferred hardeners include 1,2-bis(vinylsulfonylacetamido)ethane (BVSAE), bis(vinylsulfonyl)methane (BVSM), bis(vinylsulfonylmethyl)ether (BVSME) and bis(vinylsulfonylethyl)ether (BSEE), 1,3-bis(vinylsulfonyl)propane (BVSP), 1,3-bis(vinylsulfonyl)-2-hydroxypropane (BVSHP), 1,1,-bis(vinylsulfonyl)ethylbenzenesulfonate sodium salt, 1,1,1-tris(vinylsulfonyl)ethane (TVSE), tetrakis(vinylsulfonyl)methane, tris(acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardeners such as halogen-substituted aldehyde acids, vinyl sulfones containing other hardening functional groups, 2,3-dihydroxy-1,4-dioxane (DHD), potassium chrome alum, polymeric hardeners such as polymeric aldehydes, polymeric vinylsulfones, polymeric blocked vinyl sulfones and polymeric active halogens. The hardener may be incorporated in any amount to provide cross-linking not only to the layered material-containing layer of the invention but also to any other layer(s) of the imaging element, especially those in contact with the layered material-containing layer, for any advantageous effect. For example, BVSM may be added to a clay-containing layer to harden the clay-containing layer, as well as the bottom layer of a color negative working silver halide emulsion.

The layered material-containing layer of the invention may be formed on any flexible support, with particular preference for those, which are known for their application as supports in imaging members. The layered material-containing layer may comprise an outermost layer on either the image side or the non-image side of the support, a protective overcoat layer, a layer wherein the imaging layer is between the support and the layered material-containing layer and a layer between the support and image layer or combinations thereof. In a preferred embodiment, the element comprises a dry weight coverage on the support of the layered material-containing layer of from 10 $mg/m^2$ to 10,000 $mg/m^2$, and, preferably, a dry weight coverage of from 200 to 2000 $mg/m^2$. The Young's modulus of the support may be enhanced by the presence of the layered material-containing layer by at least 10%, or, preferably, by at least 20%. Preferably, the supports may be transparent to some degree, especially if the material is used as a photomask, or at least translucent, but in some instances, opaque supports may be useful. The support preferably exhibits dimensional stability during thermal development and has suitable adhesive properties with overlying layers.

In a preferred embodiment, the imaging element comprises a support. The support may comprise homopolymer(s), copolymer(s) and/or mixtures thereof. Typical imaging supports comprise cellulose nitrate, cellulose acetate, poly(vinyl acetate), polystyrene, polyolefins including polyolefin ionomers, polyesters including polyester ionomers, polycarbonate, polyamide, polyimide, glass, natural and synthetic paper, resin-coated, polymer-coated or laminated paper, voided polymers including polymeric foam, microvoided polymers and microporous materials, or fabric, or any combinations thereof. Preferred polymers are polyesters, such as poly(ethylene terephthalate) and poly (ethylene naphthalate), cellulose acetate and other cellulose esters, poly(vinyl acetal), polyolefins, such as polyethylene and polypropylene, polycarbonates, and polystyrenes, including polymers of styrene derivatives. Poly(ethylene terephthalate) film is a particularly useful support. Various support materials are described, for example, in *Research Disclosure*, August 1979, item 18431. A method of making dimensionally stable polyester films is described in *Research Disclosure*, September, 1999, item 42536.

mainly chosen for their desirable physical properties and cost.

Suitable polyolefins for use in the support may include polyethylene, polypropylene, polymethylpentene, polystyrene, polybutylene and mixtures thereof. Polyolefin copolymers, including copolymers of propylene and ethylene such as hexene, butene and octene and mixtures thereof are also useful.

Suitable polyesters for use in the support may include those, which are derived from the condensation of aromatic, cycloaliphatic, and aliphatic diols with aliphatic, aromatic and cycloaliphatic dicarboxylic acids and may be cycloaliphatic, aliphatic or aromatic polyesters. Exemplary of useful cycloaliphatic, aliphatic and aromatic polyesters which may be utilized in the practice of the invention are poly(ethylene terephthalate), poly(cyclohexlenedimethylene), poly(ethylene dodecate), poly(butylene terephthalate), poly(ethylene naphthalate), poly(ethylene(2,7-naphthalate)), poly(methaphenylene isophthalate), poly(glycolic acid), poly(ethylene succinate), poly(ethylene adipate), poly (ethylene sebacate), poly(decamethylene azelate), poly(ethylene sebacate), poly(decamethylene adipate), poly(decamethylene sebacate), poly(dimethylpropiolactone), poly(parahydroxybenzoate), poly(ethylene oxybenzoate), poly (ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1,5-naphthalate), poly(ethylene 2,6-naphthalate), poly(1,4-cyclohexylene dimethylene terephthalate) (cis), and poly(1,4-cyclohexylene dimethylene terephthalate (trans) and copolymers and/or mixtures thereof.

Preferred polyesters for use in the support may include poly(ethylene terephthalate), poly(butylene terephthalate), poly(1,4-cyclohexylene dimethylene terephthalate), poly (ethylene isophthalate), and poly(ethylene naphthalate) and copolymers and/or mixtures thereof. Among these polyesters of choice, poly(ethylene terephthalate) which may be modified by small amounts of other monomers, is most preferred.

The support may comprise a single layer or multiple layers according to need. The multiplicity of layers may include any number of auxiliary layers such as antistatic layers, backmark retention layers, tie layers or adhesion promoting layers, abrasion resistant layers, cuttable layers, conveyance layers, barrier layers, splice providing layers, UV absorption layers, antihalation layers, optical effect providing layers, waterproofing layers, flavor retaining layers, fragrance providing layers, adhesive layers, and imaging layers.

The support may be formed by any method known in the art such as those involving extrusion, coextrusion, quenching, orientation, heat setting, lamination, coating and solvent casting. It is preferred that the support is an oriented sheet formed by any suitable method known in the art, such as by a flat sheet process or a bubble or tubular process. The flat sheet process involves extruding or coextruding the materials of the sheet through a slit die and rapidly quenching the extruded or coextruded web upon a chilled casting drum so that the polymeric component(s) of the sheet are quenched below their solidification temperature.

The support may be subjected to any number of coatings and treatments, after extrusion, coextrusion, orientation or between casting and full orientation, to improve its properties, such as printability, barrier properties, heat-sealability, spliceability, adhesion to other supports and/or imaging layers. Examples of such coatings may be acrylic coatings for printability, polyvinylidene halide for heat seal properties. Examples of such treatments may be flame, plasma and corona discharge treatment, ultraviolet radiation treatment, ozone treatment and electron beam treatment to improve printability and adhesion. Further examples of treatments may be calendaring, embossing and patterning to obtain specific effects on the surface of the web. The support may be further incorporated in any other suitable support by lamination, adhesion, cold or heat sealing, extrusion coating, or any other method known in the art.

The supports most preferred for application in the present invention are the polymeric supports disclosed in U.S. Pat. Nos. 3,411,908, 3,501,298, 4,042,398, 4,188,220, 4,699,874, 4,794,071, 4,801,509, 5,244,861, 5,326,624, 5,395,689, 5,466,519, 5,780,213, 5,853,965, 5,866,282, 5,874,205, 5,888,643, 5,888,681, 5,888,683, 5,902,720, 5,935,690, 5,955,239, 5,994,045, 6,017,685, 6,017,686, 6,020,116, 6,022,677, 6,030,742, 6,030,756, 6,030,759, 6,040,036, 6,043,009, 6,045,965, 6,063,552, 6,071,654, 6,071,680, 6,074,788, 6,074,793, 6,083,669, 6,153,367, 6,180,227, and U.S. Pat. No. 6,197,486. These supports may comprise natural or synthetic paper, coated or laminated resin layers, voided polymers, specifically microvoided polymers, nonvoided polymers, woven polymer fibers, cloth, and various combinations thereof, in mainly image display applications. Other most preferred polymeric supports include those disclosed in U.S. Pat. Nos. 5,138,024, 5,288,601, 5,334,494, 5,360,708, 5,372,925, 5,387,501, 5,453,349, 5,556,739, 5,580,709, 6,207,361 in mainly image capture applications.

Support materials may contain various colorants, pigments, antihalation or acutance dyes if desired. Blue-tinting pigments or dyes are particularly useful. Dyes in the support may be the same or different than any dyes, such as acutance dyes, provided in layers on either side of the support. Support materials may be treated using conventional procedures, such as corona discharge, to improve adhesion of overlying layers, or subbing or other adhesion-promoting layers may be used. Useful subbing layer formulations include those conventionally used for photographic materials such as vinylidene halide polymers.

The imaging elements utilizing this invention may be of many different types depending on the particular use for which they are intended. Such imaging elements include, for example, photographic, thermographic, electrothermographic, photothermographic, dielectric recording, dye migration, laser dye-ablation, thermal dye transfer, electrostatographic, electrophotographic imaging elements, and thermally processable imaging elements.

Suitable photosensitive image-forming layers are those which provide color or black and white images. Such photosensitive layers may be image-forming layers containing silver halides such as silver chloride, silver bromide, silver bromoiodide, silver chlorobromide. Both negative and reversal silver halide elements are contemplated. For reversal films, the emulsion layers described in U.S. Pat. No. 5,236,817, especially Examples 16 and 21, are particularly suitable. Any of the known silver halide emulsion layers, such as those described in Research Disclosure, Vol. 176, Item 17643 (December, 1978), Research Disclosure, Vol. 225, Item 22534 (January, 1983), Research Disclosure, Item 36544 (September, 1994), and Research Disclosure, Item 37038 (February, 1995) and the references cited therein are useful in preparing photographic elements in accordance with this invention.

Generally, the photographic element is prepared by coating the support film with one or more layers comprising a dispersion of silver halide crystals in an aqueous solution of gelatin and optionally one or more subbing layers, such as, for example, gelatin. The coating process may be carried out on a continuously operating machine wherein a single layer or a plurality of layers are applied to the support. The layers may be coated simultaneously on the composite support film as described in U.S. Pat. No. 2,761,791 and U.S. Pat. No. 3,508,947. Additional useful coating and drying procedures are described in Research Disclosure, Vol. 176, December 1978, Item 17643.

The photographic elements according to this invention may be provided with a protective or lubricating layer, such as a wax layer, in or over the antistaic and curl control layer. Suitable lubricants include silicone oil, silicones having polar groups, fatty acid-modified silicones, fluorine-containing silicones, fluorine-containing alcohols, fluorine-containing esters and polyolefins, polyolefins, polyglycols alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 40 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 40 carbon atoms (which may contain unsaturated bonds or may be branched), alkoxy alcohols having 12 to 40 carbon atoms, mono-, di- and tri-esters of monobasic fatty acids having 10 to 40 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 40 carbon atoms and aliphatic amines having 8 to 40 carbon atoms. Specific examples of these compounds (that is, alcohols, acids or esters) include camauba wax, lauric acid, myristic acid, palmitic acid, stearic acid, behenic acid, butyl stearate, oleic acid, linoleic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Preferably, the lubricating layer is applied simultaneously with antistatic layer, and the curl control layer, where the composition of the lubricating layer includes gelatin, a viscosifier, a lubricant, and water.

In one preferred embodiment, the following layers may be applied to a subbed support. The quantities quoted each relate to g/m$^2$.

| | |
|---|---|
| Layer 1 - Antilialation Undercoat | |
| Black colloidal silver | 0.15 |
| Gelatin/layered material | 1.61 |
| Hexasodium salt of metaphosphoric acid | 0.011 |
| Disodium salt of 3,5,-disulfocatecol | 0.270 |
| 4-4-phenyl disulfide diacetanilide | 0.0012 |
| Dye 1 | 0.014 |
| Dye 2 (D-2) | 0.022 |
| Oxidized developer scavenger O-2 | 0.14 |
| Dye 5 | 0.016 |
| 4-carboxymethyl-4-thiazolone-2-thione | 0.0009 |
| Layer 2 - Slow cyan layer | |
| Tabular emulsion, 1.1 .times. .09, 4.1 mole % I | 0.27 |
| Tabular emulsion, 0.5 .times. .08, 1.3 mole % I | 0.47 |
| Gelatin | 2.01 |
| Cyan dye forming coupler C-1 | 0.48 |
| Bleach accelerator releasing coupler B-2 | 0.082 |
| Masking Coupler MC-1 | 0.028 |
| Layer 3 - Mid cyan layer | |
| Tabular emulsion, 1.3 .times. .12, 4.1 mole % I | 0.79 |
| Gelatin | 1.18 |
| Cyan dye forming coupler C-1 | 0.16 |
| Development inhibitor releasing coupler DIR-1 | 0.011 |
| Masking Coupler MC-1 | 0.022 |
| Layer 4 - Fast cyan layer | |
| Tabular emulsion, 2.5 .times. .12, 4.1 mole % I | 1.076 |
| Gelatin | 1.24 |
| Cyan dye forming coupler C-1 | 0.12 |
| Development inhibitor releasing coupler DIR-1 | 0.019 |
| Development inhibitor releasing coupler DIR-2 | 0.048 |
| Masking Coupler MC-1 | 0.032 |
| Layer 5 - Interlayer | |
| Gelatin | 0.70 |
| Oxidized developer scavenger O-2 | 0.075 |
| Layer 6 - Yellow magenta layer | |
| Tabular emulsion, 1.0 .times. .09, 4.1 mole % I | 0.24 |
| Tabular emulsion, 0.5 .times. .08, 1.3 mole % I | 0.51 |
| Gelatin | 1.18 |
| Magenta dye forming coupler M-1 | 0.30 |
| Masking Coupler MC-2 | 0.042 |
| Layer 7 - Mid magenta layer | |
| Tabular emulsion, 1.3 .times. .12, 4.1 mole % I | 0.97 |
| Gelatin | 1.32 |
| Development inhibitor releasing coupler DIR-3 | 0.024 |
| Magenta dye forming coupler M-1 | 0.057 |
| Masking Coupler MC-2 | 0.032 |
| Layer 8 - Fast magenta layer | |
| Tabular emulsion, 2.3 .times. .12, 4.1 mole % I | 0.97 |
| Gelatin | 1.55 |
| Development inhibitor releasing coupler DIR-4 | 0.011 |
| Development inhibitor releasing coupler DIR-5 | 0.011 |
| Magenta dye forming coupler M-1 | 0.088 |
| Masking Coupler MC-2 | 0.043 |

-continued

| | |
|---|---|
| Layer 9 - Yellow filter layer | |
| Yellow filter dye AD-1 | 0.16 |
| Gelatin | 0.65 |
| Oxidized developer scavenger O-2 | 0.075 |
| Layer 10 - Slow yellow layer | |
| Tabular emulsion, 1.7 .times. .13, 4.1 mole % I | 0.23 |
| Tabular emulsion, 1.1 .times. .13, 1.5 mole % I | 0.089 |
| Tabular emulsion, 0.5 .times. .08, 1.3 mole % I | 0.19 |
| Gelatin | 1.72 |
| Yellow dye forming coupler Y-3 | 0.69 |
| Development inhibitor releasing coupler DIR-7 | 0.022 |
| Bleach accelerator releasing coupler B-2 | 0.002 |
| Layer 11 - Fast yellow layer | |
| Tabular emulsion, 3.3 .times. .14, 4.1 mole % I | 0.48 |
| Gelatin | 1.38 |
| Yellow dye forming coupler Y-3 | 0.53 |
| Development inhibitor releasing coupler DIR-7 | 0.034 |
| Bleach accelerator releasing coupler B-2 | 0.006 |
| Cyan dye forming coupler C-1 | 0.022 |
| Layer 12 - UV filter layer | |
| Silver bromide Lippmann emulsion | 0.215 |
| UV-1 | 0.108 |
| UV-2 | 0.108 |
| Gelatin | 0.699 |
| Layer 13 - Protective overcoat layer | |
| Matte Beads | |
| Gelatin/layered material | 0.882 |

In a preferred embodiment, the ratio of gelatin to layered material on the same side of the support as the imaging layers is from 80:20 to 99:1. The Young's modulus of the layer is enhanced by at least 20%.

In another embodiment, on the side of the support opposite the imaging layer, the following layers were coated:

| | |
|---|---|
| Magnetic Recording Layer | |
| Gelatin | 1.025 g/m$^2$ |
| .gamma.-Iron Oxide | 0.0592 g/m$^2$ |
| .alpha.-Alumina | 0.0592 g/m$^2$ |
| Syn Fac 8337 polymeric dispersant | 0.0296 g/m$^2$ |
| Carnauba Wax | 0.204 g/m$^2$ |
| Hardener | 0.159 g/m$^2$ |
| Curl Control Layer 3 (CCL3) | |
| Gelatin/layered material | 2.493 g/m$^2$ |
| Curl Control Layer 2 (CCL2) | |
| Gelatin/layered material | 3.07 g/m$^2$ |
| Curl Control Layer 1 (CCL1) | |
| Gelatin/layered material | 3.65 g/m$^2$ |
| Antistatic Layer | |
| Zinc Antimonate colloidal particles | 0.377 g/m$^2$ |
| Gelatin | 0.067 g/m$^2$ |
| Dihydroxydioxane hardener | 0.0013 g/m$^2$ |

4 mil Polyethylene terephthalate film Subbed Support

When the layer containing gelatin and layered material is used in this embodiment, the composition of gelatin to layered material is from 80:20 to 98:2. The humidity expansion coefficient of the said layer is reduced at least 20%.

A thermal dye image receiving layer of a receiving element may be used with the invention may comprise, for example, a polycarbonate, a polyurethane, a polyester, polyvinyl chloride, poly(styrene-co-acrylonitrile), poly(caprolactone), or mixtures thereof. The dye image receiving layer may be present in any amount that is effective for the intended purpose. In general, good results have been obtained at a concentration of from 1 to 10 g/m$^2$. An overcoat layer may be coated over the dye receiving layer, such as described in U.S. Pat. No. 4,775,657 of Harrison et al.

Dye donor elements that are used with the invention conventionally comprise a support having thereon a dye containing layer. Any dye may be used in the dye donor employed in the invention, provided it is transferable to the dye receiving layer by the action of heat. Especially good results have been obtained with sublimable dyes. Dye donors applicable for use in the present invention are described, for example, in U.S. Pat. Nos. 4,916,112, 4,927,803, and U.S. Pat. No. 5,023,228. As noted above, dye donor elements are used to form a dye transfer image. Such a process comprises image wise heating a dye donor element and transferring a dye image to a dye receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three color dye transfer image. When the process is only performed for a single color, then a monochrome dye transfer image is obtained.

Thermal printing heads, which may be used to transfer dye from dye donor elements to receiving elements used with the invention, are available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye donor element, and (b) a dye receiving element as described above, the dye receiving element being in a superposed relationship with the dye donor element so that the dye layer of the donor element is in contact with the dye image receiving layer of the receiving element.

When a three color image is to be obtained, the above assemblage is formed on three occasions during the time when heat is applied by the thermal printing head. After the first dye is transferred, the elements are peeled apart. A second dye donor element (or another area of the donor element with a different dye area) is then brought in register with the dye receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps, the use of liquid toners in place of dry toners is simply one of those variations.

The first basic step, creation of an electrostatic image, may be accomplished by a variety of methods. The electrophotographic process of copiers uses imagewise photodischarge, through analog or digital exposure, of a uniformly charged photoconductor. The photoconductor may be a single use system, or it may be rechargeable and reimageable, like those based on selenium or organic photoreceptors.

In one form, the electrophotographic process of copiers uses imagewise photodischarge, through analog or digital exposure, of a uniformly charged photoconductor. The photoconductor may be a single use system, or it may be rechargeable and reimageable, like those based on selenium or organic photoreceptors.

In an alternate electrographic process, electrostatic images are created ionographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The support is charged electrostatically, with the polarity chosen to cause the toner particles to transfer to the support. Finally, the toned image is fixed to the support. For self-fixing toners, residual liquid is removed from the support by air drying or heating. Upon evaporation of the solvent, these toners form a film bonded to the support. For heat-fusible toners, thermoplastic polymers are used as part of the particle. Heating both removes residual liquid and fixes the toner to support.

When used as ink jet imaging media, the recording elements or media typically comprise a substrate or a support material having on at least one surface thereof an ink receiving or image forming layer. If desired, in order to improve the adhesion of the ink receiving layer to the support, the surface of the support may be corona discharge treated prior to applying the solvent absorbing layer to the support or, alternatively, an undercoating, such as a layer formed from a halogenated phenol or a partially hydrolyzed vinyl chloride-vinyl acetate copolymer, may be applied to the surface of the support. The ink receiving layer is preferably coated onto the support layer from water or water-alcohol solutions at a dry thickness ranging from 3 to 75 micrometers, preferably from 8 to 50 micrometers.

Any known ink jet receiver layer may be used in combination with the layered material as in the present invention. For example, the ink receiving layer may consist primarily of inorganic oxide particles such as silicas, modified silicas, clays, aluminas, fusible beads such as beads comprised of thermoplastic or thermosetting polymers, nonfusible organic beads, or hydrophilic polymers such as naturally occurring hydrophilic colloids and gums such as gelatin, albumin, guar, xantham, acacia, chitosan, starches and their derivatives, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly(ethylene imine), poly(acrylic acid), poly (methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of nonsolvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer may be overcoated with an ink permeable, antitack protective layer such as, for example, a layer comprising a cellulose derivative or a cationically modified cellulose derivative or mixtures thereof. An especially preferred overcoat is poly μ-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water based inks. The overcoat layer may also protect the ink receiving layer from abrasion, smudging, and water damage. In general, this overcoat layer may bc present at a dry thickness of from 0.1 to 5 μm, preferably from 0.25 to 3 μm.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to crosslink the coating, antioxidants, UV stabilizers, light stabilizers. In addition, a mordant may be added in small quantities (from 2% to 10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating. Some of these methods allow for simultaneous coatings of both layers, which is preferred from a manufacturing economic perspective.

The DRL (dye receiving layer) is coated over the tie layer or TL at a thickness ranging from 0.1 to 10 μm, preferably from 0.5 to 5 μm. There are many known formulations, which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166, 5,264,275, 5,104,730, 4,879,166, and Japanese Patents 1,095,091, 2,276,671, 2,276,670, 4,267,180, 5,024,335, and 5,016,517 disclose aqueous based DRL formulations comprising mixtures of psuedo-bohemite and certain water soluble resins. Light in U.S. Pat. Nos. 4,903,040, 4,930,041, 5,084,338, 5,126,194, 5,126,195, and U.S. Pat. No. 5,147,717 discloses aqueous based DRL formulations comprising mixtures of vinyl pyrrolidone polymers and certain water dispersible and/or water soluble polyesters, along with other polymers and addenda. Butters et al in U.S. Pat. Nos. 4,857,386 and U.S. Pat. No. 5,102,717 disclose ink absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous coatable DRL formulations based on poly(vinyl alcohol). Iqbal in U.S. Pat. No. 5,208,092 discloses water based DRL formulations comprising vinyl copolymers which are subsequently crosslinked. In addition to these examples, there may be other known or contemplated DRL formulations which are consistent with the aforementioned primary and secondary requirements of the DRL.

The preferred DRL is from 0.1 to 10 micrometers thick and is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers.

Although the ink receiving elements as described above may be successfully used to achieve the objectives of the present invention, it may be desirable to overcoat the DRL for the purpose of enhancing the durability of the imaged element. Such overcoats may be applied to the DRL either before or after the element is imaged. For example, the DRL may be overcoated with an ink permeable layer through which inks freely pass. Layers of this type are described in U.S. Pat. Nos. 4,686,118, 5,027,131, and U.S. Pat. No. 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, that is, continuous, piezoelectric, or thermal. Therefore, depending on the specific ink process, the inks may contain widely differing amounts and combinations of solvents, colorants, preservatives, surfactants, humectants. Inks preferred for use in combination with image recording elements are water based, such as those currently sold for use in the Hewlett-Packard Desk Writer 560C printer. However, it is intended that there are alternative embodiments of the image recording elements as described above, which may be formulated for use with inks which are specific to a given ink recording process or to a given commercial vendor.

EXAMPLES

The following examples are provided to illustrate the invention. The desired properties of modulus, humidity expansion coefficient and curl are demonstrated using model material composition.

Materials

Laponite RDS, a synthetic clay, and Cloisite® Na, a natural montmorillonite clay, both from the Southern Clay Products, Inc, Gonzales, Tex., USA, were utilized in the following samples. The properties of the clays are listed in Table 1.

TABLE 1

Properties of the Clay.

| | Aspect ratio, L/t By TEM | Surface area $m^2/g$ | Moisture content % | Cationic exchange capacity CEC (meq/100 g) |
|---|---|---|---|---|
| Cloisite ® $Na^+$ | 200:1 | 750 | 14 | 145 |
| Laponite RDS | 20–30:1 | 370 | 8 | 120 |

The gelatin used in the examples is a type 4, class 30, non-deionized gelatin. (30–122) The density of the gelatin is 1.34 $g/cm^3$.

Making of Clay-Gelatin Nanocomposite Film

Aqueous mixture of 4% solid concentration of clay and gelatin at different compositions were listed in Table 2 and were made in a 50° C. water bath using a high shear device. The coating was made on a clean polyethylene terephthalate (PET) film using a coating knife of 40 mil clearance. The coating was chill set to form the desired gel structure. The coating was then placed in ambient condition to dry for at least two days. A free-standing film of around 1 mil was peeled off the PET substrate and stored in a standard 50% RH/70° F. (21° C.) environment before further testing.

Testing—Tensile Property

All tests were performed according to the ASTM D 882-80a in a standard environment of 50 RH and 73° F. (23° C.), unless otherwise specified. The tensile test was conducted using a Sintech 2 operated via Testwork version 4.5 software with an Instron frame and load cell. A load cell of 50 lbs (23 kg) and a pair of grips of one flat and one point face were used. The sample size was 6.35 mm wide by 63.5 mm gauge length. The crosshead speed was set at 10%/min.

Five specimens were tested for each one sample, and the average and standard deviation were reported. A coefficient of variation of 5% for the modulus, 12% for the tensile strength and 15% for the elongation to break was generally observed, which includes the variation in the material and the measurement.

Testing—Humidity Expansion

A Dimensional Stability Gauge (Kodak made) was used to measure the dimension of a specimen in different relative humidities. It was calibrated by a standard 10 inch-long (25 cm) stainless steel bar. Samples of 10 inch (25 cm) long by 15 mm wide were prepared. The samples were equilibrated at certain humidity for at least one day before their dimensions were measured. The sample length at 50% RH was recorded as the original length $l_0$. Then the dimensions of samples at a series of RHs of 15, 30, 40, 50, 70, 80% were tested and the humidity expansion coefficient was calculated based on the following equation:

$$HEC = \frac{\Delta l}{l_0 \cdot \Delta RH} * 10^6 \text{ ppm}/\% \ RH \quad (1)$$

TABLE 2

Modulus and humidity expansion coefficient of coated layer (without support)

| | Cloisite ® Clay/Gelatin | Laponite clay/ Gelatin | Young's modulus GPa | Humidity expansion coefficient ppm/% RH (15–50% RH) |
|---|---|---|---|---|
| Comparative example-1 | 0/100 | | 3.3 | 435.4 |
| Comparative example-2 | | 5/100 | 3.4 | 379.4 |
| Example 1 | 1/99 | | 3.5 | |
| Example 2 | 3/97 | | 4.7 | 300.2 |
| Example 3 | 5/95 | | 5.9 | 262.1 |
| Example 4 | 10/90 | | 8.3 | 189.3 |

Note: For the evaluation of properties conducted in Table 2, the coated layers were stripped or separated from the support and evaluated alone.

Table 2 illustrates that the incorporation of the Cloisite® clay into gelatin dramatically increases the modulus and decreases the humidity expansion coefficient, as compared to the control without clay and the control sample containing Laponite clay, even at low clay loading. The films appear transparent even at 10% loading. This indicates that a clay-containing layer according to the present invention provides improved mechanical properties, such as higher stiffness or flexibility and better dimensional stability, when incorporated into an imaging element.

Testing—Humidity Curl

A model coating structure was put on a polyethylene terephthalate (PET) support to examine the performance of the curl control layer.

The following coatings are applied, using a hopper coating knife on a drawdown board, onto one side of a 120 micron thick subbed PET film. First, separate coatings using 5% gel+BVSM were prepared. These coatings were passed through a 500 micron hopper such that the dry thickness is 25 μm. Each sample was coated and then immediately chill set for 5 minutes on the coating block at 7° C. After the chill-set, the sample was removed and taped to the countertop and allowed to air dry over night.

Then, different coatings with differing amounts of clay were applied to the opposite side of each support, using a 380 micron hopper, such that the dry thickness was 15μ. Each formula was coated and chill set for 5 minutes at which time the samples were removed from the coating block and placed on the countertop to air dry overnight. Films are placed in humidity oven for 24 hours at 32.2° C./50% RH to condition.

The film was then put in 21% and 7% RH ovens at 23° C. for 24 hours. The curl of the film was read right after the film was taken out of the oven.

TABLE 3

ANSI Curl Results of Coated Support

| | | ANSI Curl (100/inch) 21% RH | ANSI Curl (100/inch) 7% RH |
|---|---|---|---|
| Comparative example-3 | 0/100 | 25 | 35 |
| Comparative example-4 | 10/90 | 40 | 55 |
| Example-5 | 3/97 | 0 | 0 |

Note: Example 5 in Table 3 is the equivalent of a gelatin coated support in combination with Example 2 in Table 2 coated on the opposite side of the gelatin coating as a curl control layer. Comparative Example 3 is the equivalent of a gelatin coated support in combination with Example 1 in Table 2 coated on the opposite side of the gelatin coating as a curl control layer. Comparative Example 4 is the equivalent of a gelatin coated support in combination with Example 4 in Table 2 coated on the opposite side of the gelatin coating as a curl control layer The data of Table 3 suggest that the addition of the layered material, specifically clay, to gelatin makes it a more effective curl control layer at a lower loading of layered material, preferably less than 10%.

The invention has been described in detail with particular reference to certain preferred embodiments thereof, but it will be understood that variations and modifications can be effected within the spirit and scope of the invention.

What is claimed is:

1. An imaging element comprising at least one imaging layer and a support wherein said support comprises at least one layer comprising a splayant and a layered material splayed by said splayant, wherein said layered material has an aspect ratio from 100:1 to 400:1, wherein said layered material has a length greater than 0 and less than or equal to 700 nm (0.7 μm), and wherein said layered material comprises less than 10% by weight of said at least one layer.

2. The imaging element of claim 1 wherein said splayant comprises an organic splayant.

3. The imaging element of claim 2 wherein said organic splayant comprises an organic hardening agent or a hydrophilic colloid.

4. The imaging element of claim 3 wherein said organic hardening agent comprises 1,2-bis(vinylsulfonylacetamido) ethane (BVSAE), bis(vinylsulfonyl)methane (BVSM), bis (vinylsulfonylmethyl)ether (BVSME) and bis(vinylsulfonylethyl)ether (BSEE), 1,3-bis(vinylsulfonyl)propane (BVSP), 1,3 -bis(vinylsulfonyl)-2-hydroxypropane (BVSHP), 1,1,-bis(vinylsulfonyl)ethylbenzenesulfonate sodium salt, 1,1,1-tris(vinylsulfonyl)ethane (TVSE), tetrakis (vinylsulfonyl)methane, tris(acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, 5-triazines, diazines, epoxides, formaldehydes, formaldehyde condensation products anhydrides, aziridines, active olefins, blocked active olefins, mixed function hardeners, vinyl sulfones containing other hardening functional groups, 2,3-dihydroxy-1,4-dioxane (DHD), potassium chrome alum, and polymeric hardeners.

5. The imaging element of claim 3 wherein said hydrophilic colloid comprises gelatin, gelatin grafted polymers, including alkali-treated gelatin (cattle bone or hide gelatin), acid-treated gelatin (pigskin or bone gelatin), and gelatin derivatives such as partially phthalated gelatin, acetylated gelatin, and deionized gelatins.

6. The imaging element of claim 2 wherein said organic splayant comprises from 30 to 90 percent weight percent of said at least one layer.

7. The imaging element of claim 1 wherein said layered material comprises clay.

8. The imaging element of claim 7 wherein said clay comprises smectite clay.

9. The imaging element of claim 8 wherein said smectite clay comprises montmorillonite.

10. The imaging element of claim 1 wherein said layered material is intercalated by said organic splayant.

11. The imaging element of claim 1 wherein said layered material is exfoliated by said organic splayant.

12. The imaging element of claim 1 wherein said layered material comprises from 0.5 to 10% parts by weight of said at least one layer.

13. The imaging element of claim 1 wherein said layered material comprises a basal plane spacing of at least 50 percent when the layered material:splayant weight ratio is changed from 100:0 to 30:70.

14. The imaging element of claim 1 wherein said imaging element comprises a photographic imaging element.

15. The imaging element of claim 1 wherein said imaging element comprises a thermophotographic imaging element.

16. The imaging element of claim 1 wherein said support is selected from the group consisting of cellulose nitrate films, cellulose acetate films, poly(vinyl acetal) films, polystyrene films, poly(ethylene terephthalate) films, poly(ethylene naphthalate) films, polycarbonate films, glass, metals, papers and polymer-coated paper.

17. The imaging element of claim 1 wherein said at least one layer comprises a curl control layer.

18. The imaging element of claim 1 wherein said at least one layer comprises a layer having improved mechanical properties.

19. The imaging element of claim 1 wherein said at least one layer comprises a curl control layer having improved mechanical properties.

20. The imaging element of claim 1 wherein said at least one layer comprises a dimensional stabilizing layer.

21. The imaging element of claim 1 wherein said at least one layer further comprises crosslinking agents, surfactants, thickeners, coalescing aids, particle dyes, matte beads and lubricants.

22. The imaging element of claim 1 wherein said at least one layer has a dry weight coverage of from 10 $mg/m^2$ to 10,000 $mg/m^2$.

23. The imaging element of claim 1 wherein said at least one layer has a dry weight coverage of from 200 to 2000 $mg/m^2$.

24. The imaging element of claim 1 wherein the Young's modulus of said support is enhanced by at least 10% as compared to the Young's modulus of the support in the absence of said at least one layer comprising a splayant and a layered material.

25. The imaging element of claim 1 wherein the Young's modulus of said support is enhanced by at least 20% as compared to the Young's modulus of the support in the absence of said at least one layer comprising a splayant and a layered material.

26. A method of making a dimensionally stable imaging element comprising providing a support wherein said support comprises at least one layer comprising a splayant and a layered material, wherein said layered material comprises an aspect ratio of from 100:1 to 400:1, wherein said layered material has a length greater than 0 and less than or equal to 700 nm (0.7 μm), and wherein said layered material comprises less than 10% by weight of said at least one layer; and applying at least one imaging layer.

27. The method of claim 26 wherein said splayant comprises at least one organic hardening agent or gelatin.

28. An imaging element comprising at least one imaging layer and a support wherein said support comprises at least one layer comprising a splayant and a natural layered clay material splayed by said splayant, wherein said natural layered clay material has an aspect ratio from 100:1 to 400:1, wherein said natural layered clay material has a length greater than 0 and less than or equal to 700 nm (0.7 μm), and wherein said natural layered clay material comprises less than 10% by weight of said at least one layer.

* * * * *

UNITED STATES PATENT AND TRADEMARK OFFICE

CERTIFICATE OF CORRECTION

PATENT NO. : 7,074,551 B2
APPLICATION NO. : 10/633904
DATED : July 11, 2006
INVENTOR(S) : YuanQiao Rao et al.

It is certified that error appears in the above-identified patent and that said Letters Patent is hereby corrected as shown below:

Column 21, line 10 delete "5-triazines," replace with --s-triazines,--

Signed and Sealed this

Third Day of April, 2007

JON W. DUDAS
*Director of the United States Patent and Trademark Office*